US009476586B2

(12) United States Patent
Chen

(10) Patent No.: US 9,476,586 B2
(45) Date of Patent: Oct. 25, 2016

(54) MODULAR WICK HOLDER

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 288 days.

(21) Appl. No.: 14/198,687

(22) Filed: Mar. 6, 2014

(65) Prior Publication Data

US 2015/0030988 A1 Jan. 29, 2015

(30) Foreign Application Priority Data

Jul. 23, 2013 (TW) ..... 102126282 A
Jan. 20, 2014 (TW) ..... 103102020 A

(51) Int. Cl.

| | |
|---|---|
| ***A61L 9/02*** | (2006.01) |
| ***F23D 3/30*** | (2006.01) |
| ***F23D 3/24*** | (2006.01) |
| *F23D 14/28* | (2006.01) |
| *F23D 5/02* | (2006.01) |

(52) U.S. Cl.

CPC . *F23D 3/30* (2013.01); *F23D 3/24* (2013.01); *F23D 5/02* (2013.01); *F23D 14/28* (2013.01)

(58) Field of Classification Search

CPC ..... F23D 4/24; F23D 3/30; F23D 14/28; F23D 5/02

USPC ..... 431/315, 344, 333, 323, 320; 126/43, 126/44; 422/5, 126

See application file for complete search history.

(56) References Cited

U.S. PATENT DOCUMENTS

| | | | | |
|---|---|---|---|---|
| 3,096,754 A * | 7/1963 | Solomon | F24B 1/1802 | 126/503 |
| 3,428,407 A * | 2/1969 | Yoshida | F23D 5/00 | 431/249 |
| 5,529,485 A | 6/1996 | D'Ambro | | |
| 6,267,113 B1 * | 7/2001 | Maust | F24C 3/006 | 126/512 |

(Continued)

FOREIGN PATENT DOCUMENTS

| | | |
|---|---|---|
| BE | 413976 A | 3/1936 |
| TW | 542330 U | 7/2003 |

(Continued)

*Primary Examiner* — Gregory Huson
*Assistant Examiner* — Nikhil Mashruwala
(74) *Attorney, Agent, or Firm* — Alan D. Kamrath; Kamrath IP Lawfirm, P.A.

(57) ABSTRACT

A modular wick holder includes a first wick holder assembly and a second wick holder assembly joined together. The first and second wick holder assemblies are disposed symmetrical to each other. The first wick holder assembly includes a first projection, and the second wick holder assembly includes a second projection opposite and corresponding to the first projection. The first and second projections delimit a space therebetween. When the modular wick holder combines with a wick, the wick is securely held by the space. At least one adjusting member inserts through the first and second wick holder assemblies and is operable to move the first and second projections closer and to have the space include a reduced size.

20 Claims, 16 Drawing Sheets

(56) References Cited

U.S. PATENT DOCUMENTS 6,555,069 B1 4/2003 Ferguson
6,991,453 B2 * 1/2006 Decker ..... A61L 9/037 126/45
7,022,213 B1 4/2006 Austen et al.
7,287,979 B2 * 10/2007 Backes ..... F23D 5/04 431/338
7,467,944 B2 * 12/2008 Furner ..... F21V 37/00 431/289
2007/0020574 A1 * 1/2007 Kubicek ..... F23D 3/24 431/298
2009/0238717 A1 * 9/2009 Nolan ..... F23D 3/24 422/5
2009/0291400 A1 * 11/2009 Levy ..... A61L 9/037 431/120
2014/0057219 A1 2/2014 Nolan

FOREIGN PATENT DOCUMENTS

TW M435542 U 8/2012
WO 2005/077426 A1 8/2005

* cited by examiner

MODULAR WICK HOLDER

BACKGROUND OF THE INVENTION

1. Field of the Invention

The present invention relates to a wick holder and, in particular, to a wick holder which is modularly designed.

2. Description of the Related Art

TW Patent No. M435542 shows a wick holder that is disposed inside a fuel tank when holding a wick. The wick holder includes a base that the inner periphery of the fuel tank can stably bear. The wick holder includes the base receiving a distal end of the wick in order to hold the wick. The wick is fixedly disposed on the base. However, a user can not change the wicking speed that the wick draws fuel and therefore controlling the scale of a flame. Also, the heat generated by the flame can be transferred to the fuel in the container easily. Once the flame scale is large, it may cause the fuel to become overheated and create a risk.

U.S. Pat. No. 6,555,069 shows a wick holder restrained in a cap of a fuel tank. A wick that is held by the wick holder includes a distal end outward of the cap and another distal end disposed in the fuel tank. Likewise, a user can not change the wicking speed that the wick draws fuel. During burning, the flame can be very close to the wick holder and transfer heat generated by the flame above to the container. In addition, the user can not fill up the fuel tank without removing the wick and cap from the fuel tank, and needs to wait till it is cooled down to be safe to remove the cover. After fuel refilling, a user has to wait a period of time to ignite the wick, since the wick has to be soaked through by the fuel wicking before ignition.

The present invention is, therefore, intended to obviate or at least alleviate the problems encountered in the prior art.

SUMMARY OF THE INVENTION

According to the present invention, a modular wick holder includes a first wick holder assembly and a second wick holder assembly being separate parts and joined together. The first and second wick holder assemblies are disposed symmetrical to each other. The first wick holder assembly includes a first projection, and the second wick holder assembly includes a second projection opposite and corresponding to the first projection. The first and second projections delimit a space therebetween. When the modular wick holder combines with a wick, the wick is securely held by the space. At least one adjusting member inserts through the first and second wick holder assemblies and is operable to move the first and second projections closer and to have the space include a reduced size.

It is therefore an objective of the present invention to provide a wick holder that can control the wicking speed that a wick draws fuel by adjusting the clamping forces and that changes the gap space that holds the wick. The clamping forces can be adjusted by the at least one adjusting member that inserts through the first and second wick holder assemblies.

It is another objective of the present invention for the fuel inside the tank to effectively insulate the heat generated by the flame above to avoid the risk caused by overheated fuel.

It is another objective of the present invention to provide a wick holder that can allow a fuel refilling operation in a safe and convenient way.

It is another objective of the present invention to minimize the waiting time before ignition due to the wick module being well soaked at the same time during refilling.

Other objectives, advantages, and new features of the present invention will become apparent from the following detailed description of the invention when considered in conjunction with the accompanied drawings.

DETAILED DESCRIPTION OF THE INVENTION

Figure 1:
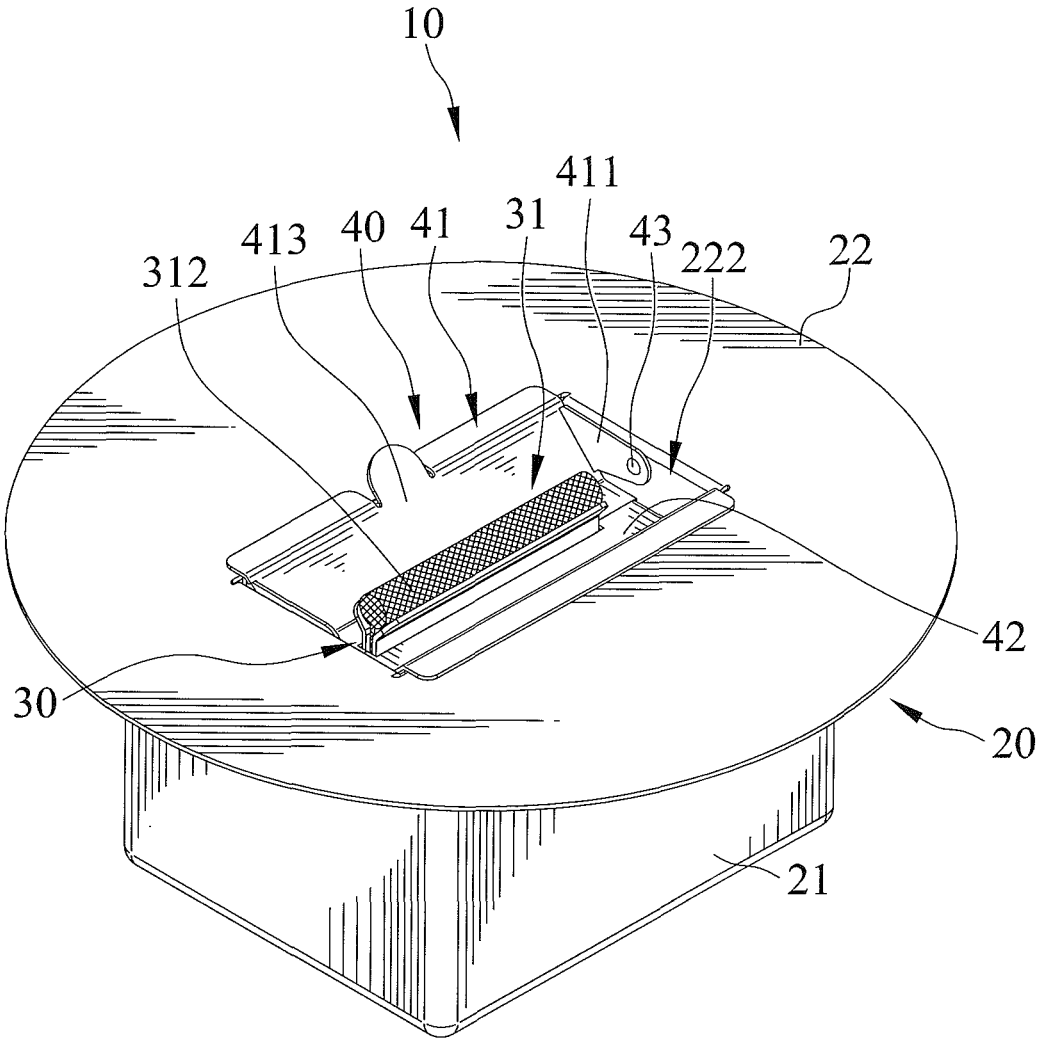
FIG. 1 is a perspective view of a flame device with a modular wick holder in accordance with a first embodiment of the present invention.
Figure 2:
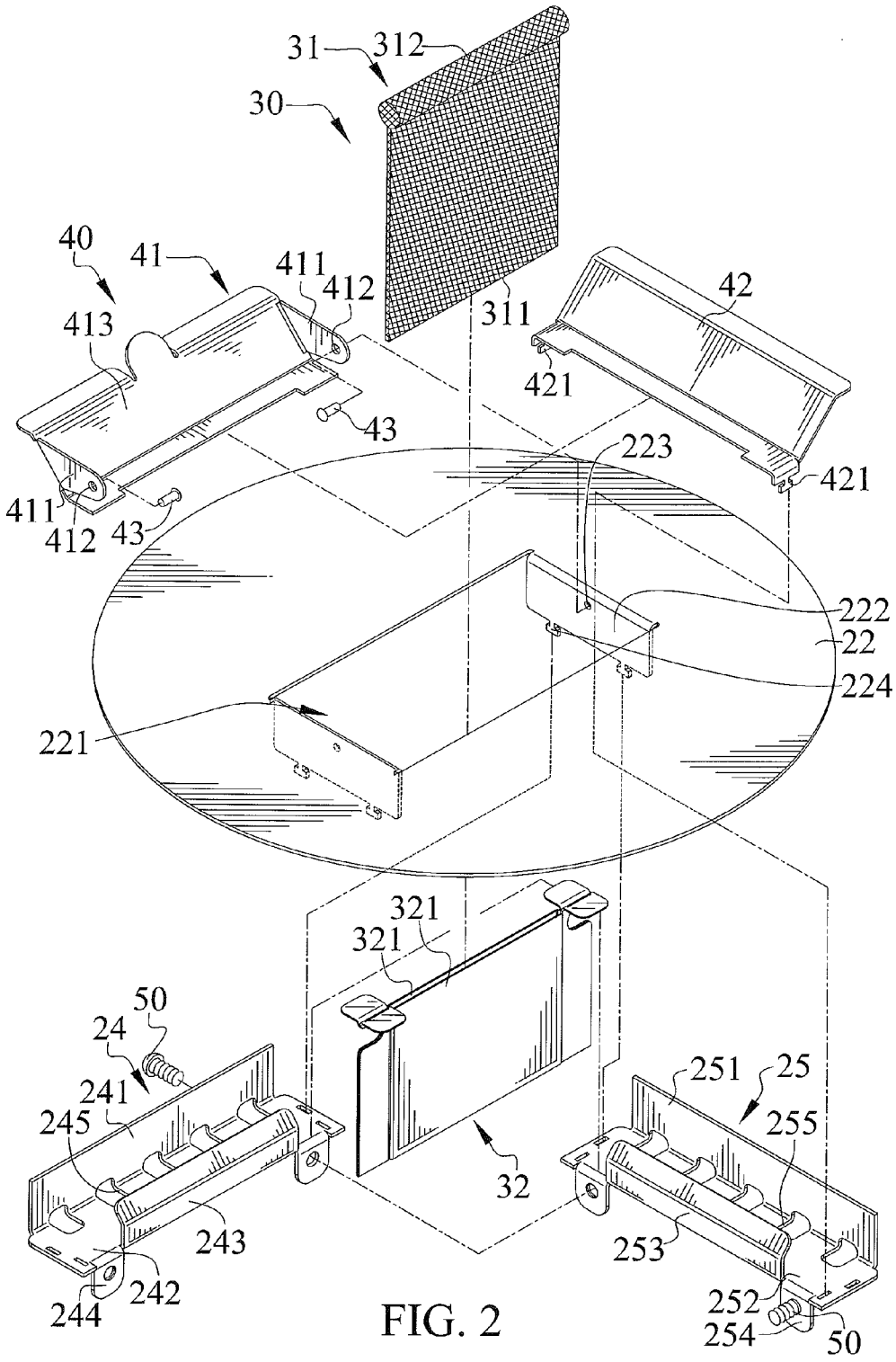
FIG. 2 is an exploded perspective view of the flame device.
Figure 3:
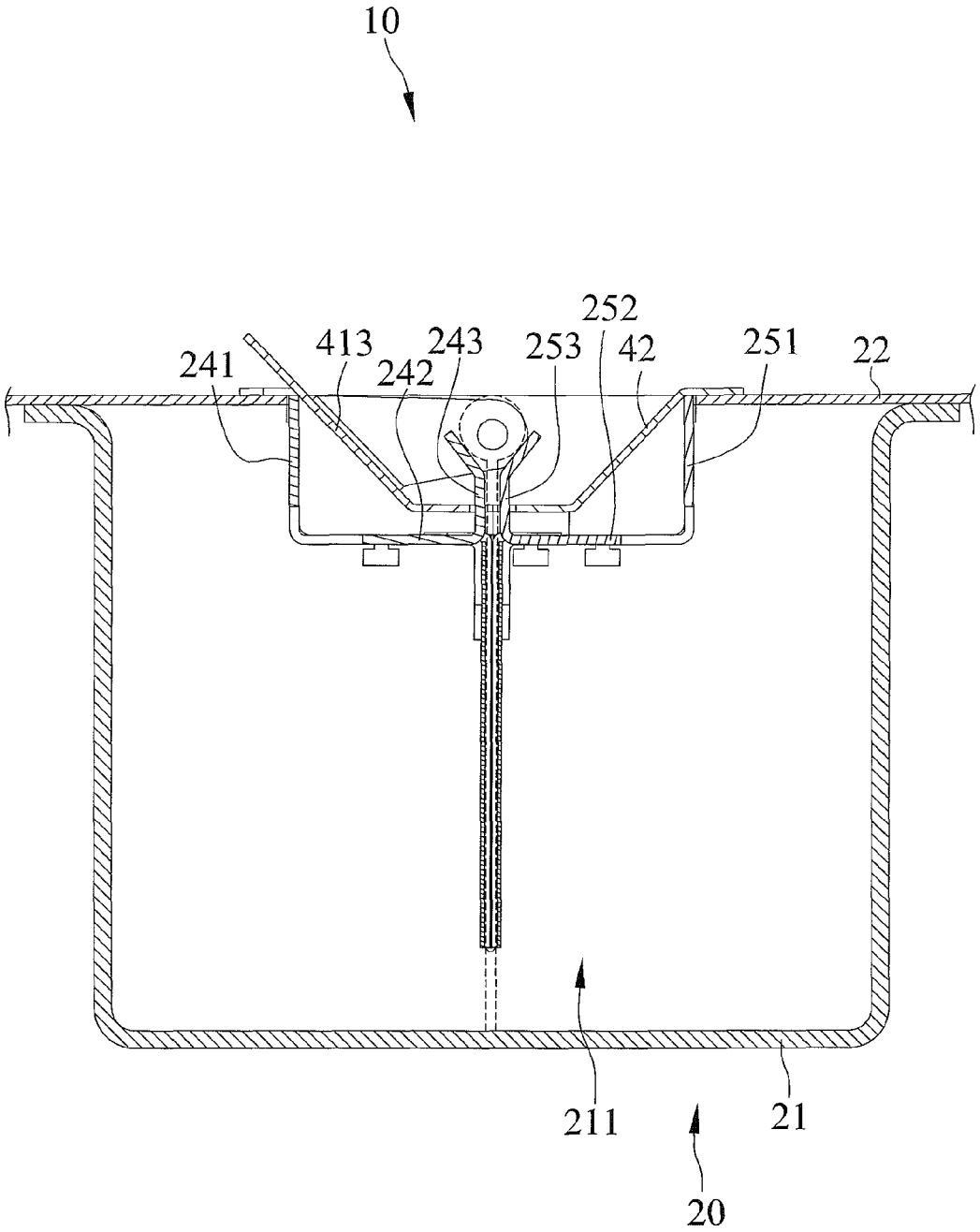
FIG. 3 is a cross-sectional view of the flame device.
Figure 4:
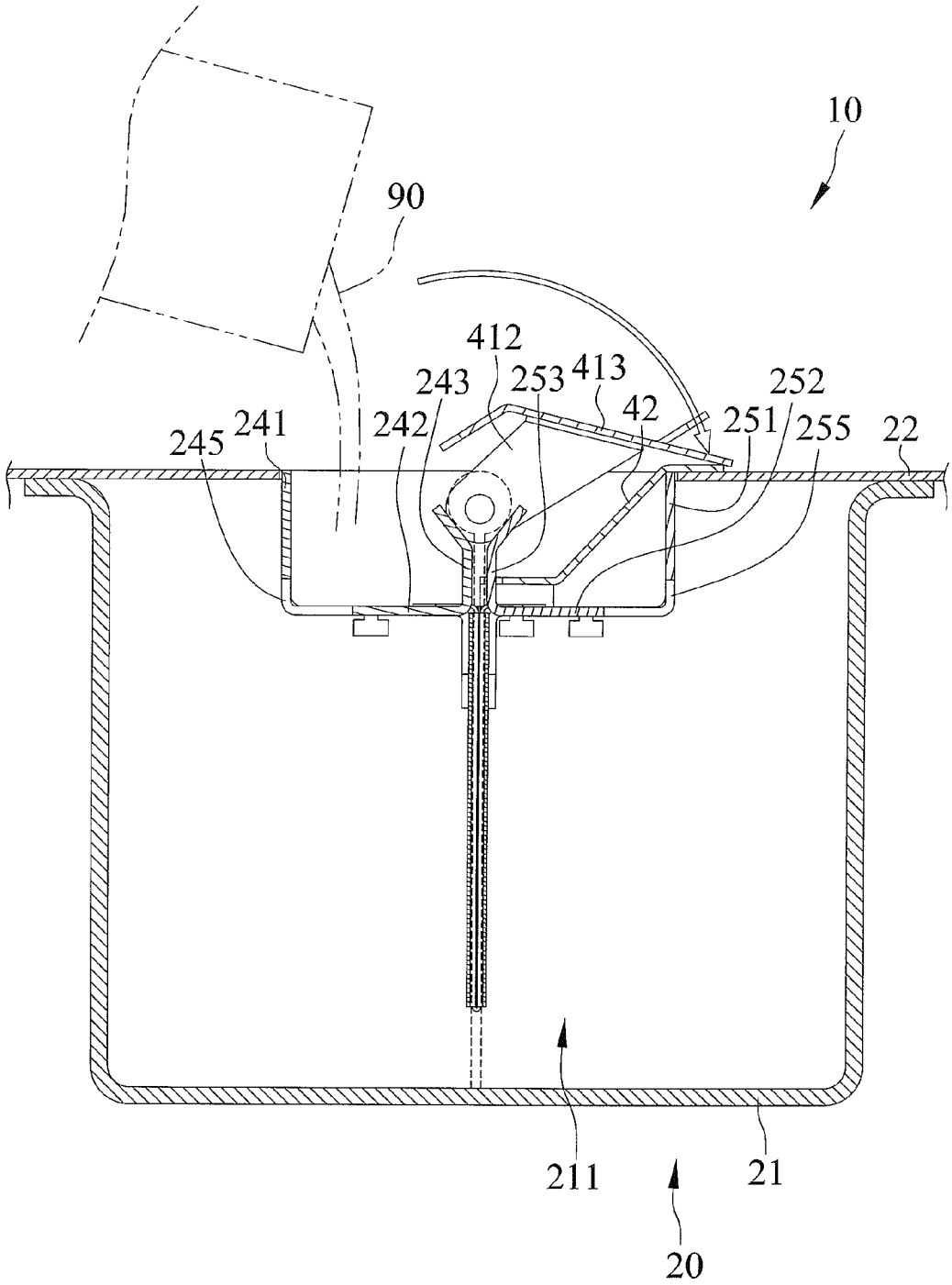
FIG. 4 is a cross-sectional view showing the flame device in a fuel tank fill-up operation.
Figure 5:
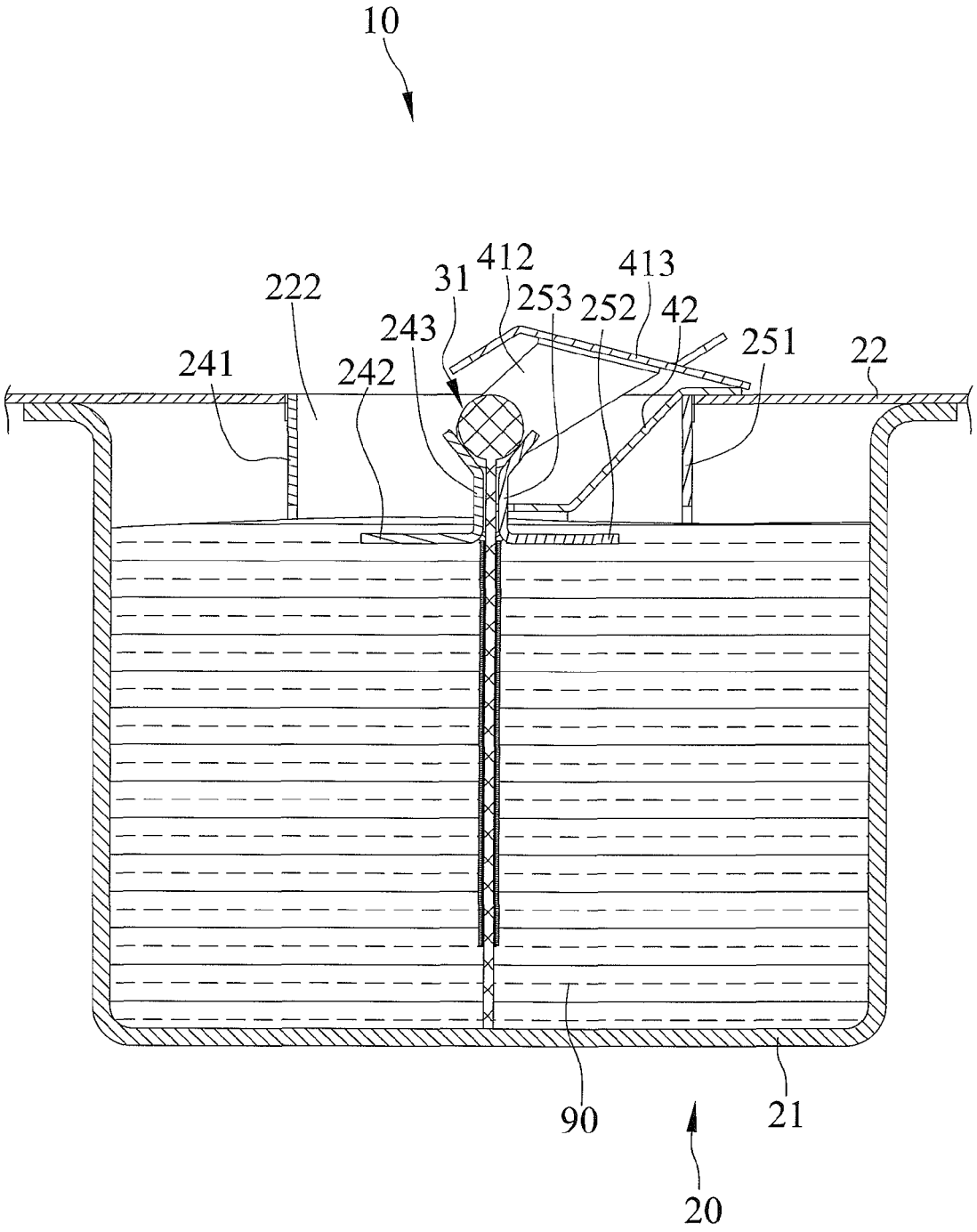
FIG. 5 is a continued cross-sectional view of FIG. 4, showing the flame device filled with fuel.
Figure 6:
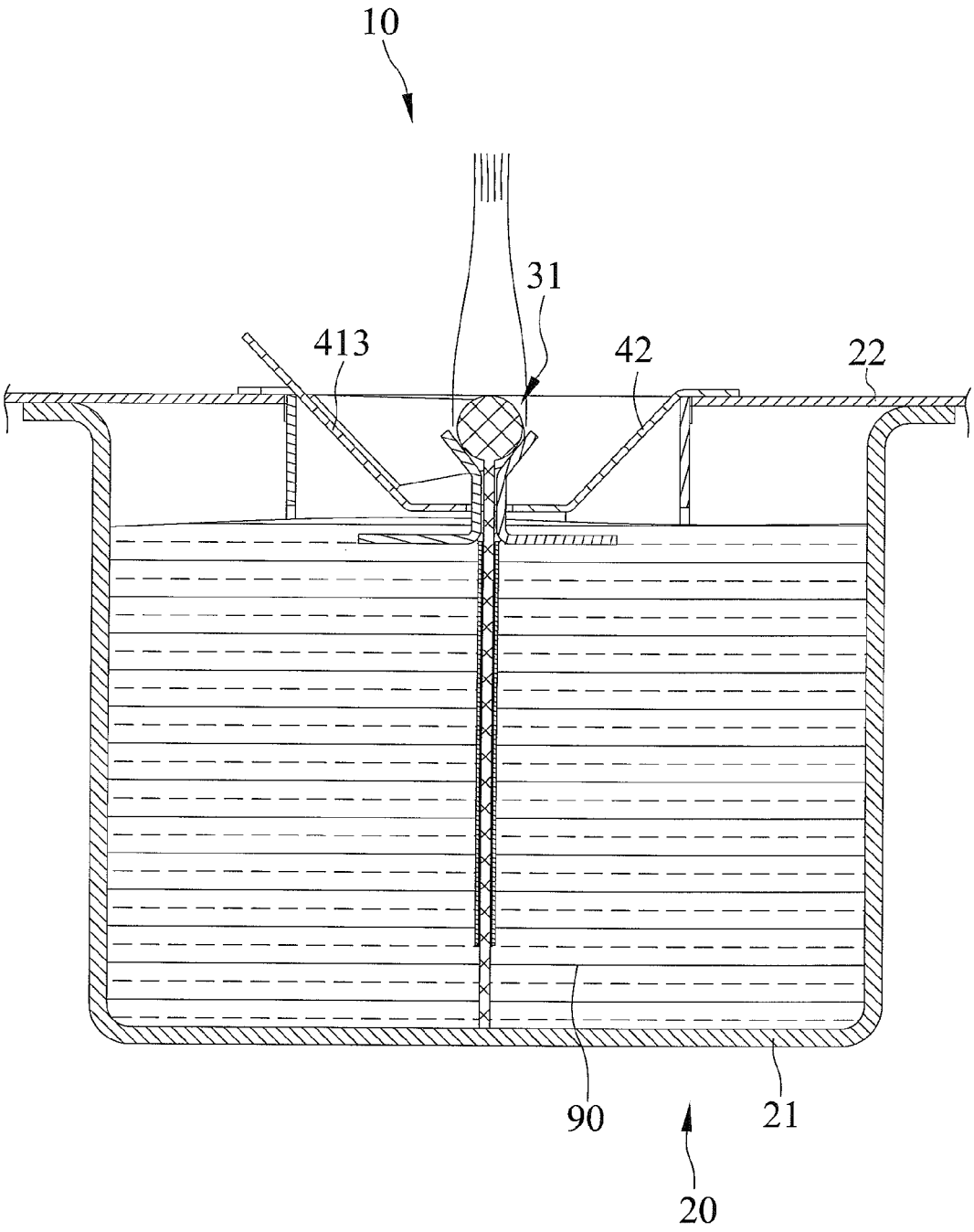
FIG. 6 is a cross-section view showing the flame device in operation, with the modular wick holder holding a wick, with the wick drawing up fuel to a flame.
Figure 7:
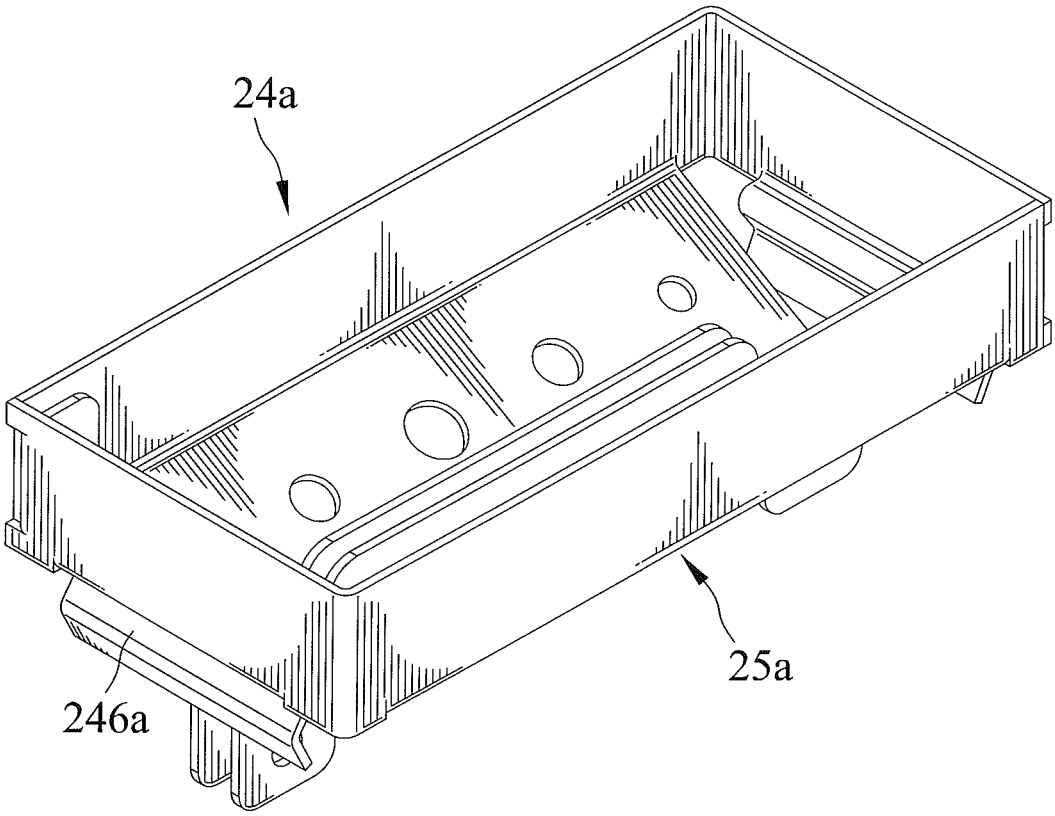
FIG. 7 is a perspective view of a modular wick holder in accordance with a second embodiment of the present invention.
Figure 8:
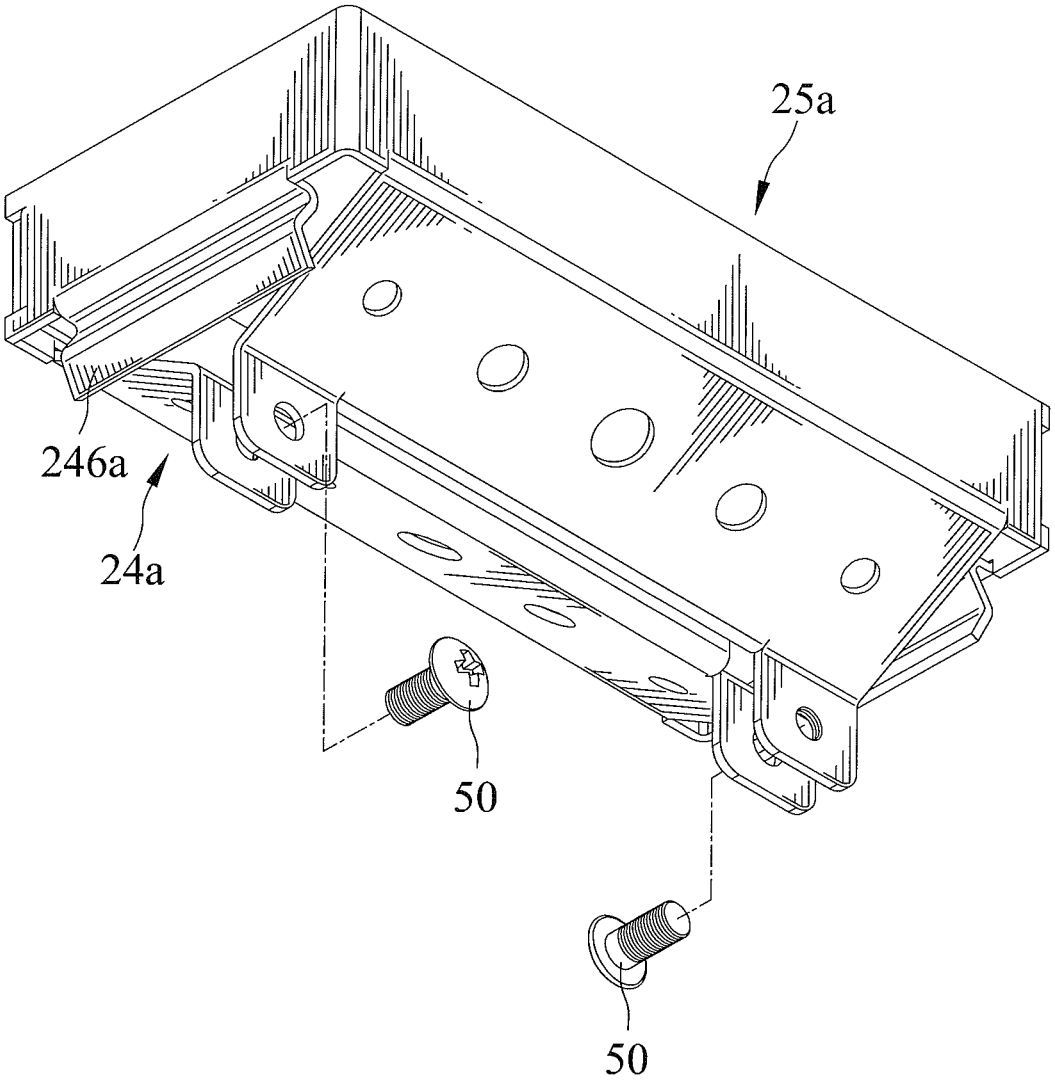
FIG. 8 is a perspective view of the wick holder, viewed from a different angle than FIG. 7.
Figure 9:
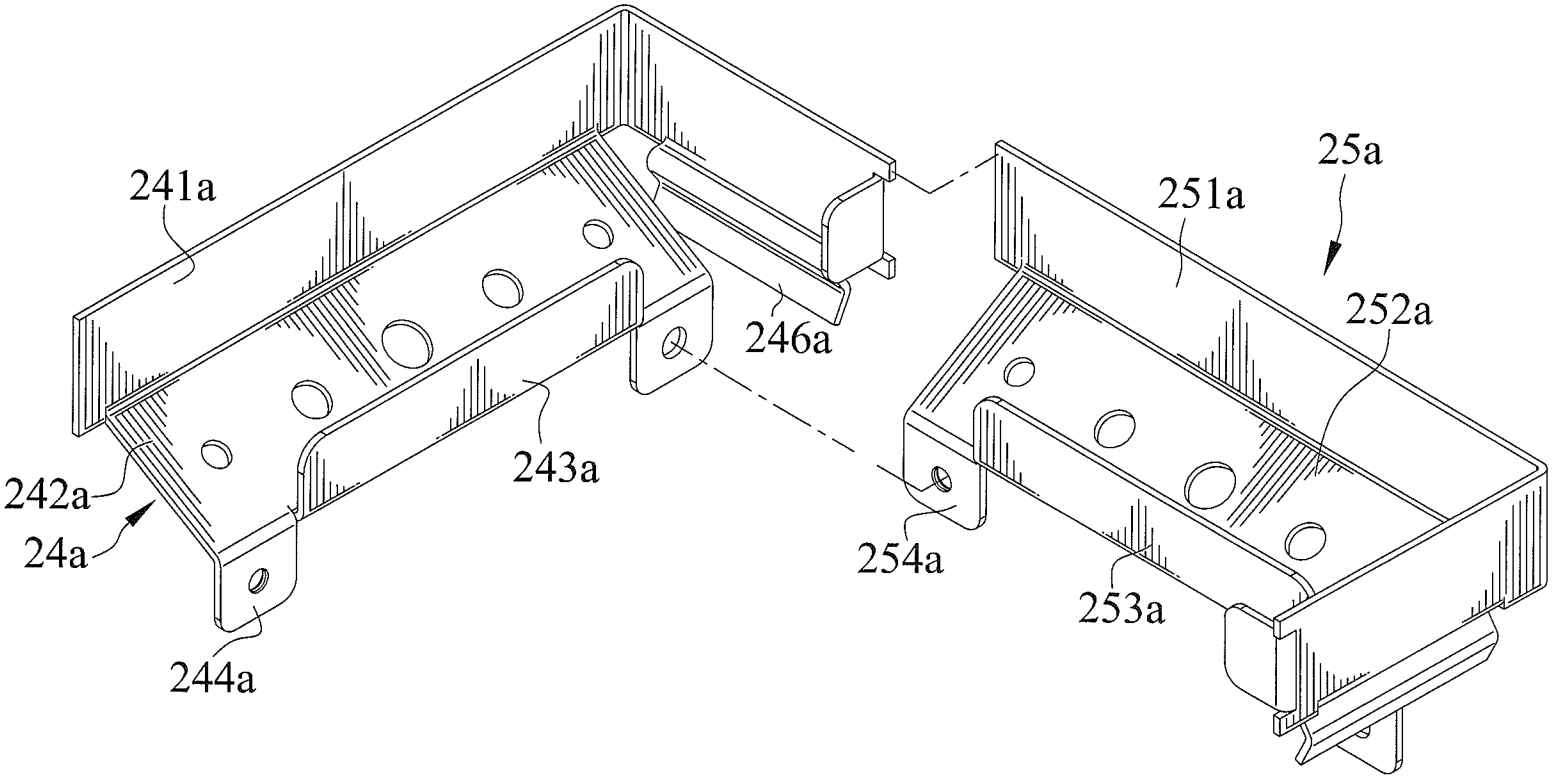
FIG. 9 is an exploded perspective view of the modular wick holder of FIG. 7.
Figure 10:
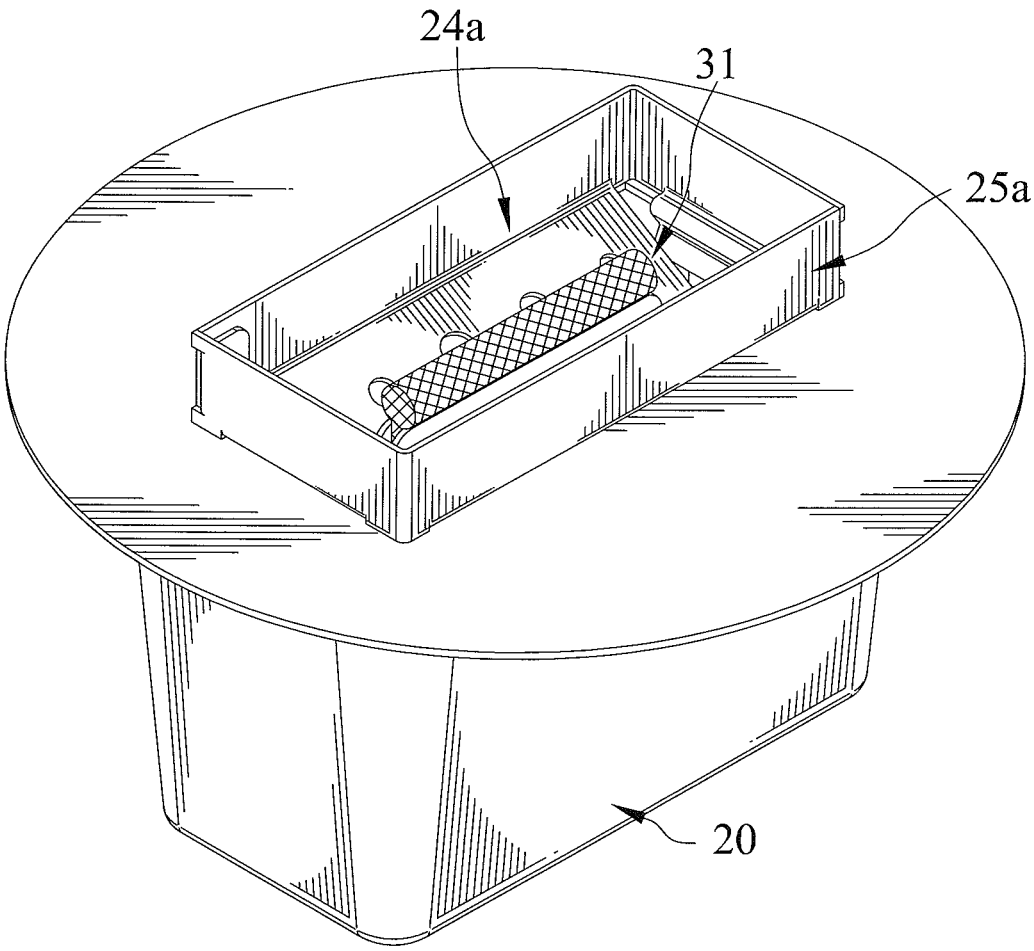
FIG. 10 is a perspective view of a flame device with the modular wick holder of FIG. 7.
Figure 11:
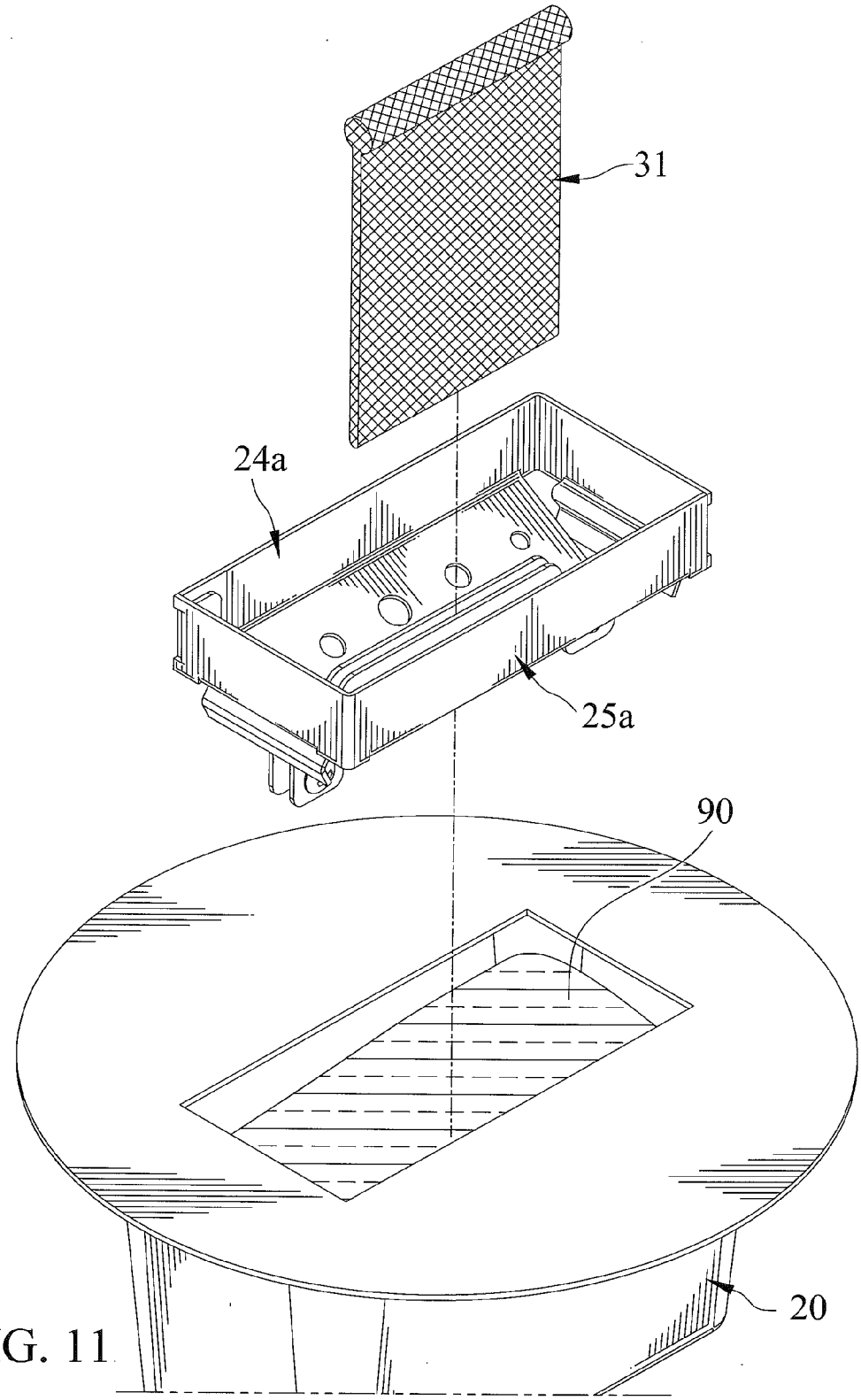
FIG. 11 is an exploded perspective view of FIG. 10.
Figure 12:
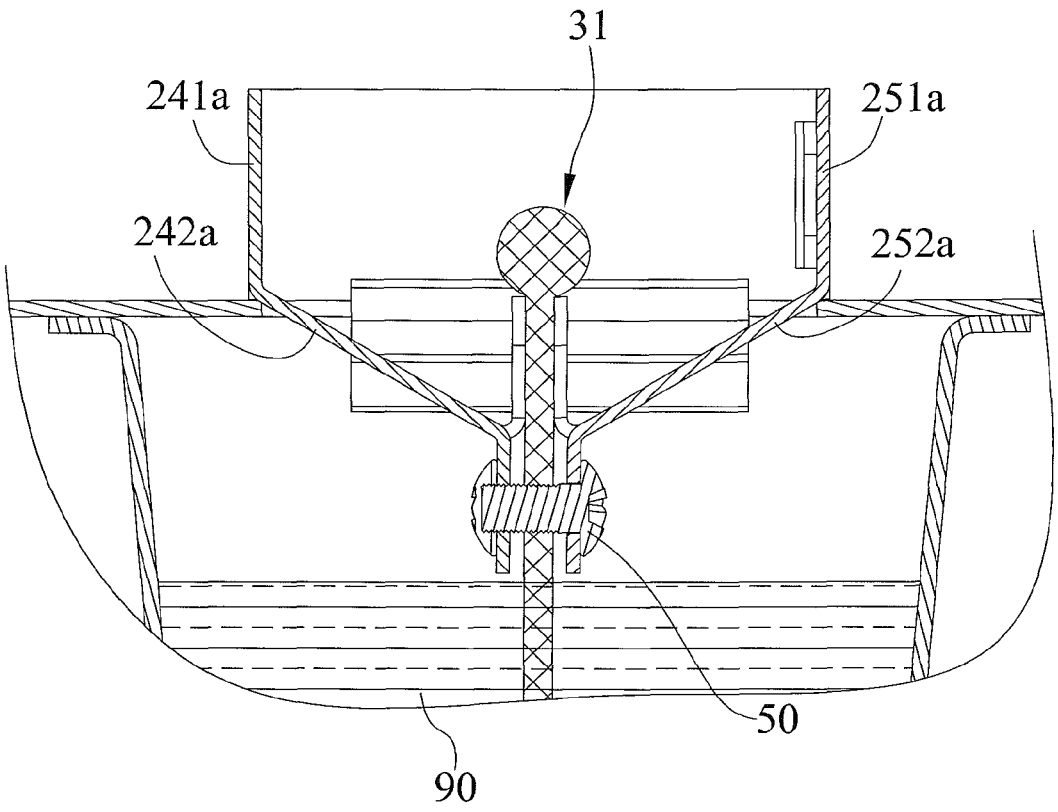
FIG. 12 is a partial cross-sectional view of FIG. 10.
Figure 13:
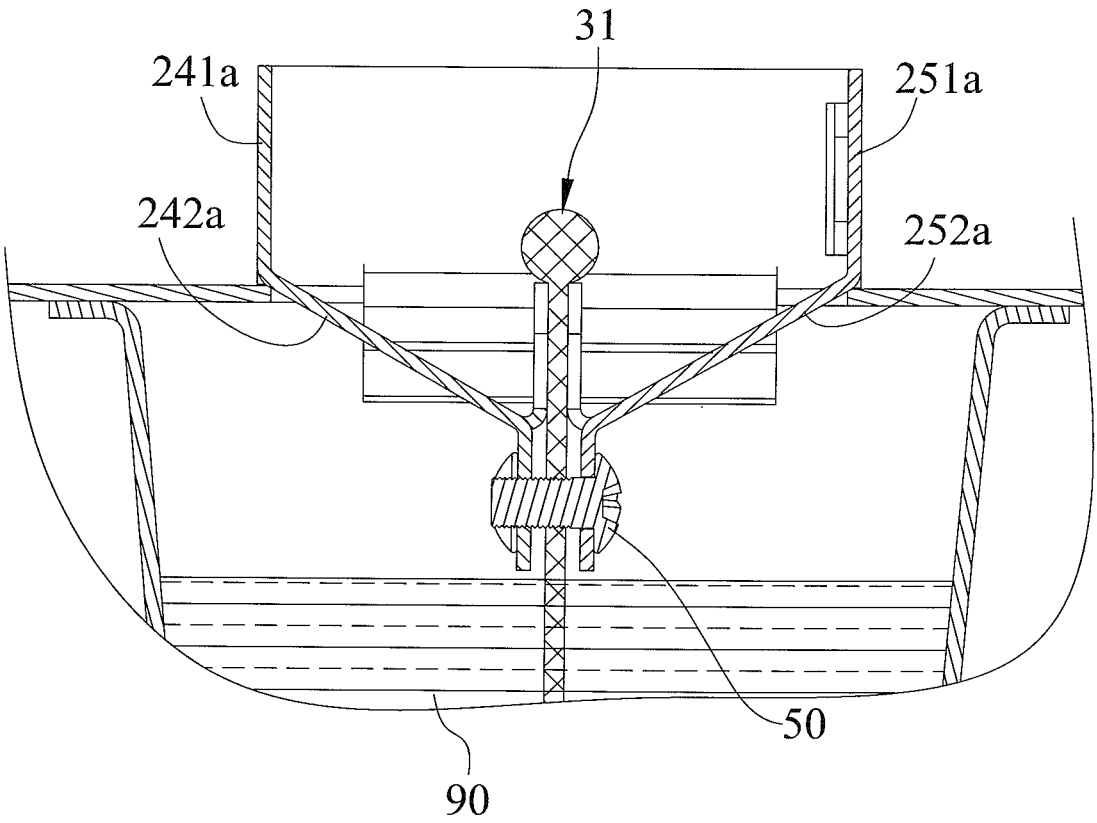
FIG. 13 is an extended cross-sectional view of FIG. 12, showing the wick holder holding a wick that is different than the wick shown in FIG. 12, with the wicks absorbing fuel at different rates.

FIGS. 1 through 6 show a modular wick holder in accordance with a first embodiment of the present invention. The modular wick holder includes a first wick holder assembly 24 and a second wick holder assembly 25 being separate parts and joined together. The first and second wick holder assemblies 24 and 25 are disposed symmetrical to each other.

A wick mechanism 30 includes a wick 31 and a wick frame 32. The wick frame 32 has a shape including two frame edges 321 with a gap in between. The wick 31 includes a plurality of meshes. The wick 31 has a shape including a bottom 311 and a tip 312 enlarged than the bottom 311. The wick 31 includes the bottom 311 thereof received in the wick frame 32, with the wick frame 32 including two opposite frame edges 321 abutting against the bottom 311 of the wick 31. The wick frame 32 has a shape including two frame edges 321 with a gap in between.

The first wick holder assembly 24 includes a first projection 243, and the second wick holder assembly 25 includes a second projection 253 opposite and corresponding to the first projection 243. The first and second projections 243 and 253 delimit a space therebetween. The space has a flared size adjacent to tips of the first and second projections 243 and 253. When the modular wick holder receives the wick 31, the wick 31 is securely received by the space. The slanted tips of the first and second projections 243 and 253 receive the tip 312 of the wick 31. Therefore, it will not suffer a problem that wind blows out a flame on the wick 31. The first wick holder assembly 24 has a shape including a lateral edge 241 and a bottom edge 242 cornering from the lateral edge 241. The second wick holder assembly 25 has a shape including a lateral edge 251 and a bottom edge 252 cornering from the lateral edge 251. The first wick holder assembly 24 includes at least one third projection 244, and the second wick holder assembly 25 includes at least one fourth projection 254 corresponding to the at least one third projection 244, with the at least one third projection 244 and the at least one fourth projection 254 including the space in between. The first projection 243 extends from the bottom edge 242. The second projection 253 extends from the bottom edge 252. The first projection 243 corners from the bottom edge 242. The second projection 253 corners from the bottom edge 252. The first projection 243 and the lateral edge 241 are opposite each other. The second projection 253 and the lateral edge 251 are opposite each other. At least one third projection 244 extends from the bottom edge 242. The at least one third projection 244 and the first projection 243 extend oppositely. At least one fourth projection 254 extends from the bottom edge 252. The at least one fourth projection 254 and the second projection 253 extend oppositely. The at least one third projection 244 corners from the bottom edge 242. The at least one fourth projection 254 corners from the bottom edge 252. The first wick holder assembly 24 includes at least one first venthole 245 extending therethrough. The at least one first venthole 245 extends through inner and outer edges of the first wick holder assembly 24. The lateral and bottom edges 241 and 242 delimit the at least one first venthole 245. In the embodiment, the first wick holder assembly 24 delimits a plurality of first ventholes 245. The plurality of first ventholes 245 is aligned. The second wick holder assembly 25 includes at least one second venthole 255 extending therethrough. The at least one second venthole 255 extends through inner and outer edges of the second wick holder assembly 25. The lateral and bottom edges 251 and 252 delimit the at least one second venthole 255. In the embodiment, the second wick holder assembly 25 delimits a plurality of second ventholes 255. The plurality of second ventholes 255 is aligned. The first wick holder assembly 24 and the second wick holder assembly 25 have the same shape.

A shield 40 is disposed above the first and second wick holder assemblies 24 and 25. The shield 40 has an open position and a closed position. The shield 40 includes a first shield assembly 41 and a second shield assembly 42 joined to the first shield assembly 41. The first shield assembly 41 and the second shield assembly 42 are pivotally joined together. The first shield assembly 41 includes an edge defining a sheltering edge 413, and the wick 31 is sheltered when the shield 40 is in the open position thereof. The sheltering edge 413 extends obliquely.

At least one adjusting member 50 inserts through the first and second wick holder assemblies 24 and 25 and is operable to move the first and second projections 243 and 253 closer and to have the space include a reduced size. The at least one third projection 244 and the at least one fourth projection 254 are inserted by the at least one adjusting member 50.

A flame device 10 that includes the modular wick holder includes a fuel tank 20. The wick 31 has a distal end received and drawing fuel 90 in the fuel tank 20 and another distal end outward the fuel tank 20 and the modular wick holder. The fuel tank 20 includes a tank 21 and a cap 22 capping the tank 21. The tank 21 delimits a containing space 211 with an opening. In a fuel tank fill-up operation, fuel 90 is filled into the containing space 211 through the opening. The cap 22 delimits a hole 221 extending therethrough. The hole 221 extends through first and second sides of the cap 22. The hole 221 connects to and is in communication with the containing space 211 when the cap 22 caps the tank 21. The cap 22 includes at least one connecting edge 222 protruding therefrom. In the embodiment, the cap 22 includes two connecting edges 222 protruding therefrom. The two connecting edges 222 are spaced from each other, with the hole 221 disposed therebetween. The cap 22 is fixed on the first and second wick holder assemblies 24 and 25. The cap 22 includes at least two joining structures 224 with one joining structure 224 fixing the first wick holder assembly 24 and the other fixing the second wick holder assembly 25.

The wicking speed that the wick 31 draws fuel 90 is modified by adjusting the clamping forces and thus changes the space that holds the wick 31. The clamping forces can be adjusted by the at least one adjusting member 50 that inserts through the first and second wick holder assemblies 24 and 25.

The shield 40 engages with the fuel tank 20 and is disposed above the first and second wick holder assemblies 24 and 25. The shield 40 includes the first shield assembly 41 pivotally joined to the cap 22. The first shield assembly 41 includes two arms 411 pivotally mounted on the two connecting edges 222. Each of the connecting edges 222 delimits a first orifice 223, and each of the two arms 411 delimits a second orifice 412, respectively. The first shield assembly 41 is pivotal about a pivot 43. The pivot 43 engages in the first and second orifices 223 and 412. The shield 40 includes the second shield assembly 42 fixed on the second wick holder assembly 25. The second shield assembly 42 includes at least one fixing structure 421 fixing the second wick holder assembly 25.

The shield 40 reveals the opening of the fuel tank 20 when the shield 40 is in the open position thereof, thereby allowing a fuel tank fill-up operation. The shield 40 reveals the hole 221 and the tip 312 of the wick 31 when the shield 40 is in the open position thereof. The shield 40 closes the opening of the fuel tank 20 when the shield 40 is in the closed position thereof. The shield 40 closes the hole 221 when the shield 40 is in the closed position thereof. The first shield assembly 41 includes the sheltering edge 413 thereof covering the tip 312 of the wick 31 to prevent inadvertent lighting of the wick 31 when the shield 40 is in the open position thereof. The plurality of first and second ventholes 245 and 255 disposed underneath the hole 221 is also sheltered by the shield 40.

During combustion, if heat generated by the flame is not insulated or dissipated properly, heat may accumulate in a flame device and cause a temperature rise. High temperature not only causes risks to users in operation, but also create creates a deflagration hazard. If the fuel inside container of the flame device is heated to above the flash point temperature, deflagration may occur.

In the invention, the flame is detached from a fuel container with a distance between the flame and the fuel container. Also, an extra insulation layer, i.e., the first and second wick holder assemblies 24 and 25 and the shield 40, is designed between the flame and the fuel container. If the flame scale is large, this insulation layer can insulate the heat from entering the fuel container. Since the insulation layer is designed with a larger area, it can also dissipate heat to surrounding air.

Furthermore, when a user needs to refill fuel, the hinged insulation layer, i.e., the shield 40, is flipped open for ease of refilling. This is also a foolproof design to ensure the insulation shield 40 is flipped back, as otherwise, one cannot ignite the wick.

FIGS. 7 through 13 show a modular wick holder in accordance with a second embodiment of the present invention, and the same numbers are used to correlate similar components of the first embodiment, but bearing a letter a. For comparison, the modular wick holder includes a first wick holder assembly 24*a* and a second wick holder assembly 25*a*. Each of the first and second wick holder assemblies 24*a* and 25*a* has a shape including a lateral edge 241*a* and 251*a* and a bottom edge 242*a* and 252*a* cornering from the lateral edge 241*a* and 251*a*. A first projection 243*a* extends from the bottom edge 242*a*. A second projection 253*a* extends from the bottom edge 252*a*. The first projection 243*a* corners from the bottom edge 242*a*. The second projection 253*a* corners from the bottom edge 252*a*. The first projection 243*a* and the lateral edge 241*a* are opposite each other. The second projection 253*a* and the lateral edge 251*a* are opposite each other. The first and second projections 243*a* and 253*a* delimit a space therebetween. When the modular wick holder receives the wick 31, the wick 31 is securely received by the space. The first wick holder assembly 24*a* includes at least one third projection 244*a*, and the second wick holder assembly 25*a* includes at least one fourth projection 254*a* corresponding to the at least one third projection 244*a*. The at least one third projection 244*a* extends from the bottom edge 242*a*. The at least one third projection 244*a* and the first projection 243*a* extend oppositely. The at least one fourth projection 254*a* extends from the bottom edge 252*a*. The at least one fourth projection 254*a* and the second projection 253*a* extend oppositely. The at least one third projection 244*a* corners from the bottom edge 242*a*. The at least one fourth projection 254*a* corners from the bottom edge 252*a*. The at least one third projection 244*a* and the at least one fourth projection 254*a* include the space in between and are inserted by the at least one adjusting member 50.

The second embodiment differentiates from the first embodiment in that the first and second wick holder assemblies 24*a* and 25*a* and the cap 22 are fixed to the cap 22 in another way. The combination of the first and second wick holder assemblies 24*a* and 25*a* includes two flexible retaining structures 246*a* fixing to the cap 22. The two retaining structures 246*a* abut against the two connecting edges 222 of the cap 22. The flexible retaining structure 246*a* has a shape forming a ridge. One of the two retaining structures 246*a* extends from the lateral edge 241*a*. The other of the two retaining structures 246*a* extends from the lateral edge 251*a*. The combination of the first and second wick holder assemblies 24*a* and 25*a* includes the two retaining structures 246*a* disposed symmetrically and spaced from each other. The lateral edges 241*a* and 251*a* and the bottom edges 242*a* and 252*a* have a different included angle than that between the lateral edges 241 and 251 and the bottom edges 242 and 252. In the first embodiment, the included angle is substantially 90 degrees. In the second embodiment, the included angle is greater than 90 degrees and less than 180 degrees, i.e., the bottom edges 242*a* and 252*a* extend obliquely from the lateral edges.

Figure 14:
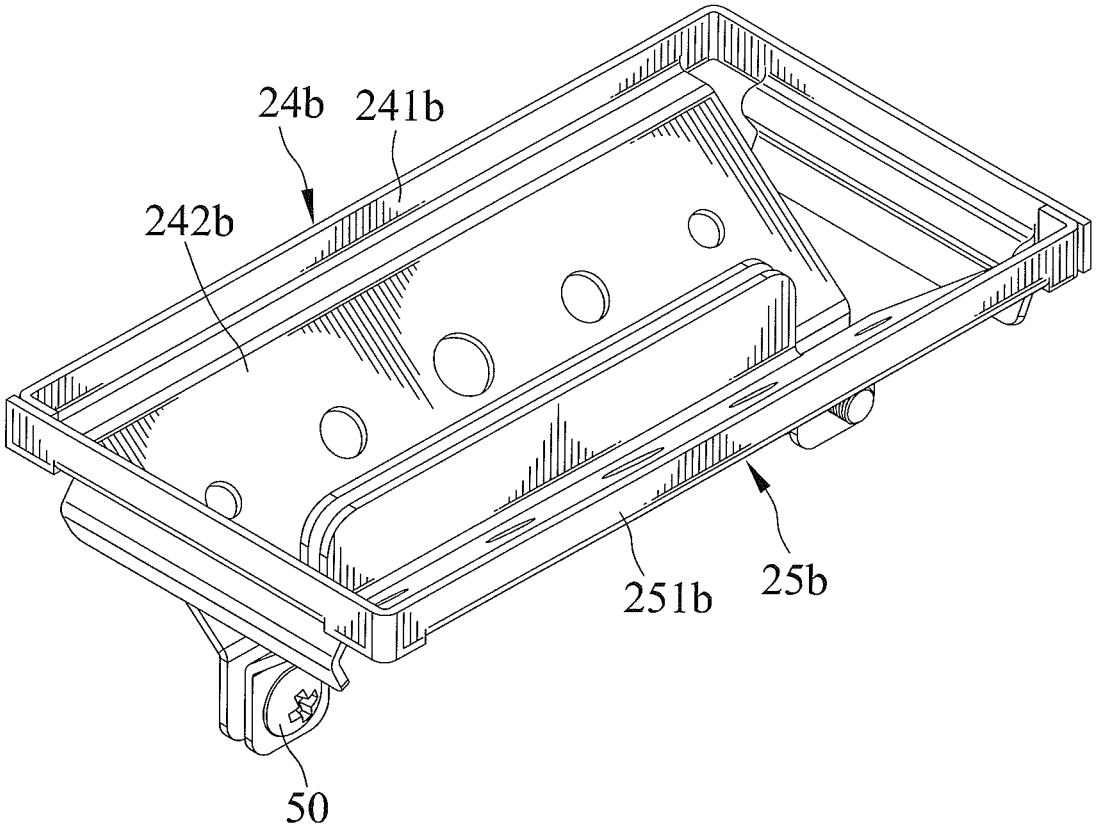
FIG. 14 is a perspective view of a modular wick holder in accordance with a third embodiment of the present invention.
Figure 15:
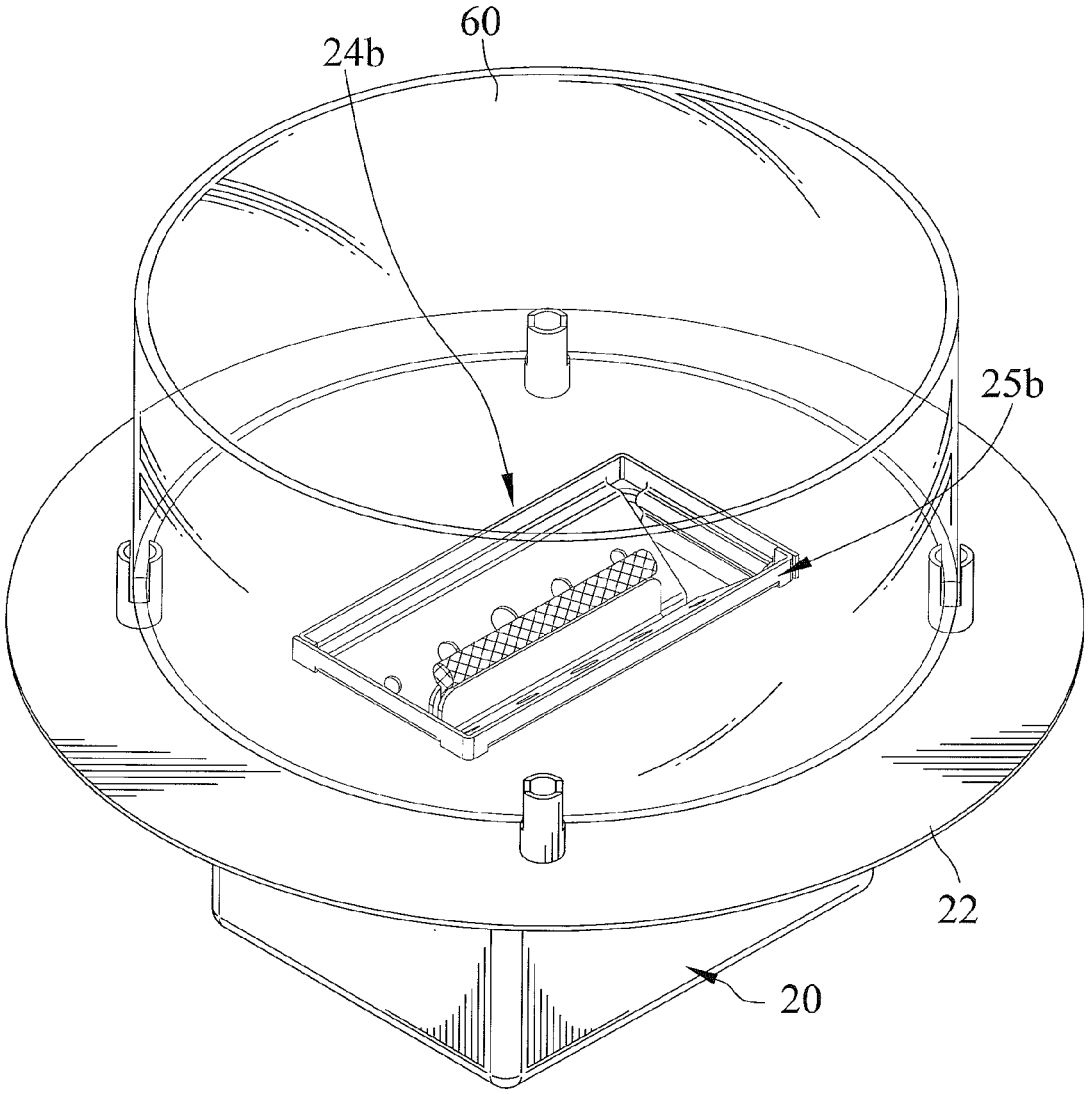
FIG. 15 is a perspective view of a flame device with the modular wick holder of FIG. 14.
Figure 16:
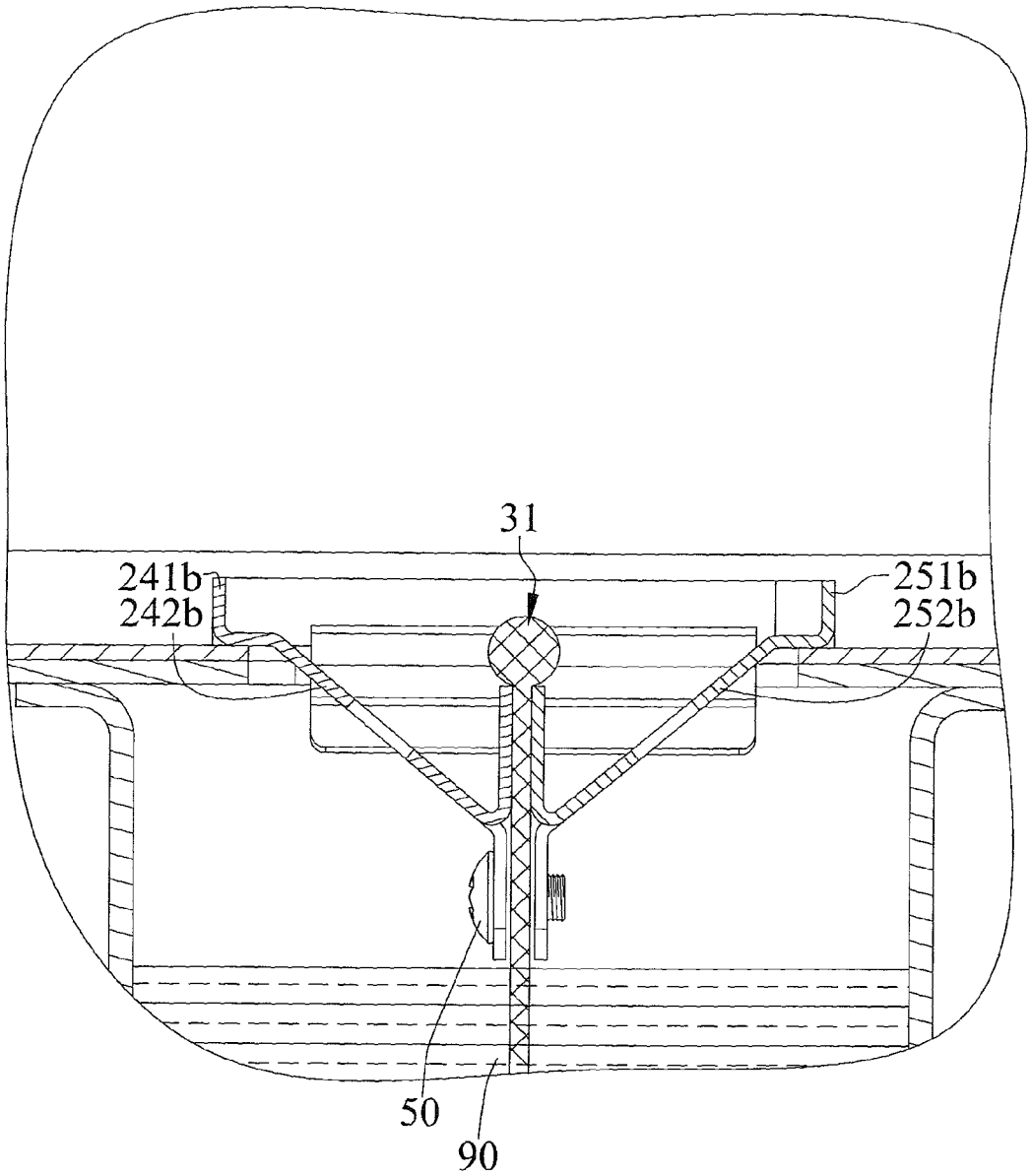
FIG. 16 is a partial cross-sectional view of FIG. 15.

FIGS. 14 through 16 show a modular wick holder in accordance with a third embodiment of the present invention, and same numbers are used to correlate similar components of the second embodiment, but bearing a letter b. The third embodiment is similar to the second embodiment except that each of first and second wick holder assemblies 24*b* and 25*b* includes a bottom edge 242*b* and 252*b* extending substantially perpendicular to a lateral edge 241*b* and 251*b* to a first length and then obliquely to a second length. Each of the first and second wick holder assemblies 24*b* and 25*b* including the bottom edges 242*b* and 252*b* thereof and the fuel tank 20 have a surface contact, making the fuel tank 20 stably support the modular wick holder. Further, an enclosure 60 is disposed on the fuel tank 20. The enclosure is disposed on the cap 22. The enclosure 60 has a shape of a tube and delimits two open distal ends. Therefore, the flame device 10 including the enclosure 60 will not suffer an air circulation problem. The enclosure 60 can also block wind from blowing out the flame. The enclosure 60 is transparent.

In view of the forgoing, each of the modular wick holders includes first and second wick holder assemblies 24, 24*a*, 24*b*, 25, 25*a* and 25*b*. The first and second wick holder assemblies 24, 24*a*, 24*b*, 25, 25*a* and 25*b* are symmetrical. It is easy to assemble the first and second wick holder assemblies 24, 24*a*, 24*b*, 25, 25*a* and 25*b* together. The cost of manufacturing the modular wick holders is also reduced.

Fuel 90 in the fuel tank 20 is double insulated from heat by the modular wick holder and the shield 40, and the flame is kept outside the fuel tank 20, which effectively prevents fuel 90 in the fuel tank 20 from being overheated.

The tip 312 of the wick 31 that holds the flame is partially received in the first and second wick holder assemblies 24, 24*a*, 24*b*, 25, 25*a* and 25*b* to block wind from blowing out the flame.

The cap 22 is a thin metal piece that dissipates heat quickly to effectively prevent heat transfer to the fuel tank 20.

The shield 40 in the closed position thereof prevents fuel 90 from spilling out of the fuel tank 20 inadvertently.

While the specific embodiments have been illustrated and described, numerous modifications come to mind without significantly departing from the spirit of invention, and the scope of invention is only limited by the scope of the accompanying claims.

What is claimed is:

1. A modular wick holder comprising:

a first wick holder assembly and a second wick holder assembly being two separate parts and joined together, with the first and second wick holder assemblies disposed symmetrical to each other, with the first wick holder assembly including a first projection and the second wick holder assembly including a second projection opposite and corresponding to the first projection, with the first and second projections delimiting a space therebetween, wherein when the modular wick holder combines with a wick, the wick is securely held by the space with clamping forces by and between the first and second projections; and at least one adjusting member inserting through the first and second wick holder assemblies and operable to move the first and second projections closer and to have the space include a reduced size.

2. The modular wick holder as claimed in claim 1, wherein each of the first and second wick holder assemblies has a shape including a lateral edge and a bottom edge cornering from the lateral edge, and wherein the first projection extends and corners from the bottom edge of the first wick holder assembly and the second projection extends and corners from the bottom edge of the second wick holder assembly, respectively.

3. The modular wick holder as claimed in claim 2, wherein the first wick holder assembly includes at least one third projection spaced from the first projection and the second wick holder assembly includes at least one fourth projection spaced from the second projection and corresponding to the at least one third projection, with the at least one third projection and the at least one fourth projection including the space in between and inserted by the at least one adjusting member.

4. The modular wick holder as claimed in claim 3, wherein the at least one third projection extends from the bottom edge of the first wick holder assembly opposite to the first projection and the at least one fourth projection extends from the bottom edge of the second wick holder assembly opposite to the second projection.

5. The modular wick holder as claimed in claim 1, wherein the space has a flared size adjacent to tips of the first and second projections.

6. The modular wick holder as claimed in any claim 1, wherein each of the first and second projections includes a slanted tip, and wherein when the modular wick holder receives the wick, the tip of the wick is sheltered by the slanted tips of the first and second projections.

7. The modular wick holder as claimed in claim 1, wherein each of the first and second wick holder assemblies includes at least one venthole extending therethrough.

8. A flame device comprising:

a fuel tank;

a modular wick holder assembly including a first wick holder assembly and a second wick holder assembly being separate parts and joined together, with the first and second wick holder assemblies disposed symmetrical to each other, with the first wick holder assembly including a first projection and the second wick holder assembly including a second projection opposite and corresponding to the first projection, with the first and second projections delimiting a space therebetween;

a wick having a distal end received and drawing fuel in the fuel tank and another distal end outward the fuel tank and the modular wick holder, with the wick received in the space and clamped by and between the first and second projections; and at least one adjusting member inserting through the first and second wick holder assemblies and operable to move the first and second projections closer and to have the space include a reduced size.

9. The modular wick holder as claimed in claim 8 further comprising an enclosure disposed on the fuel tank, wherein the enclosure has a shape of a tube and delimits two open distal ends.

10. The modular wick holder as claimed in claim 8, wherein the wick includes a plurality of meshes.

11. The modular wick holder as claimed in claim 8, wherein each of the first and second projections includes a slanted tip, and wherein when the modular wick holder receives the wick, the tip of the wick is sheltered by the slanted tips of the first and second projections.

12. The modular wick holder as claimed in claim 8, wherein the space has a flared size adjacent to tips of the first and second projections.

13. The modular wick holder as claimed in claim 8, wherein each of the first and second wick holder assemblies has a shape including a lateral edge and a bottom edge cornering from the lateral edge, and wherein the first projection extends and corners from the bottom edge of the first wick holder assembly and the second projection extends and corners from the bottom edge of the second wick holder assembly, respectively, wherein the first wick holder assembly includes at least one third projection spaced from the first projection and the second wick holder assembly includes at least one fourth projection spaced from the second projection and corresponding to the at least one third projection, with the at least one third projection and the at least one fourth projection including the space in between and inserted by the at least one adjusting member, wherein the at least one third projection extends from the bottom edge of the first wick holder assembly opposite to the first projection and the at least one fourth projection extends from the bottom edge of the second wick holder assembly opposite to the second projection.

14. A flame device comprising:

a modular wick holder assembly including a first wick holder assembly and a second wick holder assembly being separate parts and joined together, with the first and second wick holder assemblies disposed symmetrical to each other, with the first wick holder assembly including a first projection and the second wick holder assembly including a second projection opposite and corresponding to the first projection, with the first and second projections delimiting a space therebetween receiving a wick, with the wick having a distal end received and drawing fuel in a fuel tank and another distal end outward the fuel tank and the modular wick holder;

at least one adjusting member inserting through the first and second wick holder assemblies and operable to move the first and second projections closer and to have the space include a reduced size; and a shield engaging with the fuel tank and disposed above the first and second wick holder assemblies, and wherein the shield has an open position and a closed position, with the shield revealing an opening of the fuel tank when the shield is in the open position thereof, thereby allowing a fuel tank fill-up operation, and with the shield closing the opening of the fuel tank when the shield is in the closed position thereof.

15. The flame device as claimed in claim 14, wherein the shield shelters the wick when the shield is in the open position thereof, and wherein the shield reveals the wick when the shield is in the closed position thereof.

16. The modular wick holder as claimed in claim 15, wherein each of the first and second wick holder assemblies has a shape including a lateral edge and a bottom edge cornering from the lateral edge, and wherein the first projection extends and corners from the bottom edge of the first wick holder assembly and the second projection extends and corners from the bottom edge of the second wick holder assembly, respectively.

17. The modular wick holder as claimed in claim 16, wherein the space has a flared size adjacent to tips of the first and second projections.

18. The modular wick holder as claimed in claim 17, wherein each of the first and second projections includes a slanted tip, and wherein when the modular wick holder receives the wick, the tip of the wick is sheltered by the slanted tips of the first and second projections.

19. The modular wick holder as claimed in claim 18, wherein the wick includes a plurality of meshes.

20. The modular wick holder as claimed in claim 19 further comprising an enclosure disposed on the fuel tank, wherein the enclosure has a shape of a tube and delimits two open distal ends.

* * * * *